United States Patent [19]

Lewandowski

[11] 4,002,873

[45] Jan. 11, 1977

[54] ILLUMINATED PUSHBUTTON SWITCH

[75] Inventor: Raymond F. Lewandowski, Mount Prospect, Ill.

[73] Assignee: Oak Industries Inc., Crystal Lake, Ill.

[22] Filed: Feb. 6, 1975

[21] Appl. No.: 547,436

[52] U.S. Cl. ..... 200/314; 200/159 R

[51] Int. Cl.[2] ..... H01H 9/00

[58] Field of Search ..... 200/159 R, 159 A, 159 B, 200/308–317

[56] References Cited

UNITED STATES PATENTS

| | | | |
|---|---|---|---|
| 3,626,171 | 12/1971 | Abramowitz | 200/314 |
| 3,663,780 | 5/1972 | Goldbeck | 200/314 |
| 3,826,884 | 7/1974 | Lewandowski | 200/159 R |

OTHER PUBLICATIONS

IBM Technical Disclosure Bulletin, vol. 16, No. 3, Aug. 1973, "Illuminated Keybutton Module" G. M. O'Donnell, pp. 822–823.

*Primary Examiner*—Robert K. Schaefer
*Assistant Examiner*—Morris Ginsburg
*Attorney, Agent, or Firm*—Kinzer, Plyer, Dorn & McEachron

[57] ABSTRACT

A pushbutton switch has a button telescopically mounted on a switch base and a contact with a plurality of outwardly extending arms positioned between the button and the base. One group of arms is disposed for contact with the terminals within the base and another group of arms is positioned to receive the actuating force from the button. Illuminating means are positioned within the base and are disposed to direct light through an opening in the contact toward a light transmissive portion of the button.

1 Claim, 8 Drawing Figures fig.1.
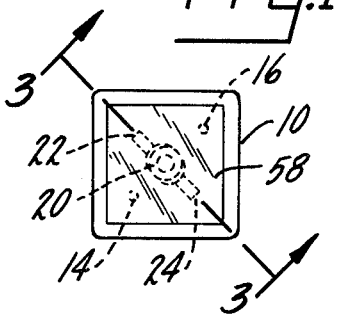
fig.2.
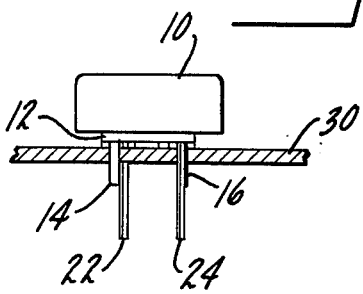
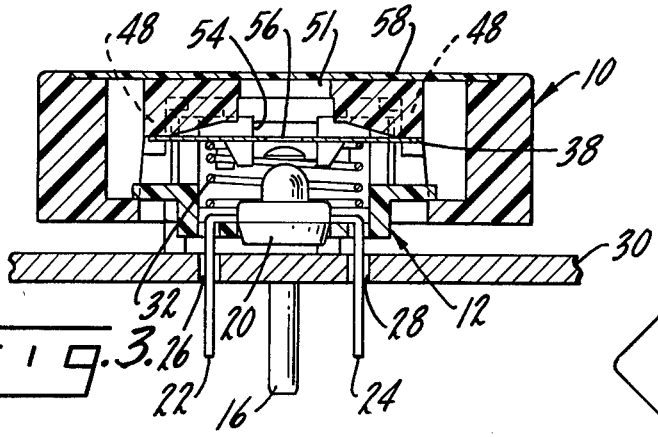
fig.3.
fig.4.
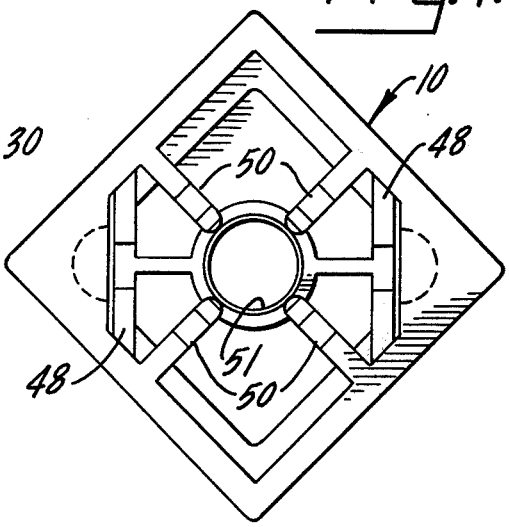
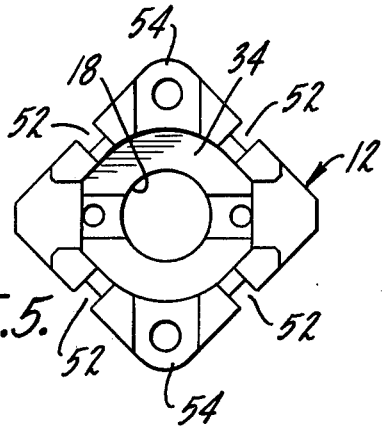
fig.5.
fig.7.
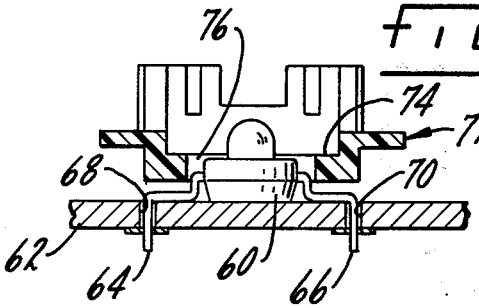
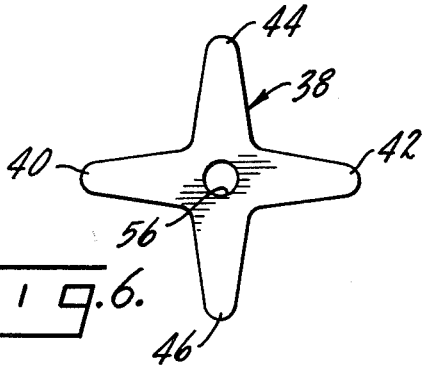
fig.6.
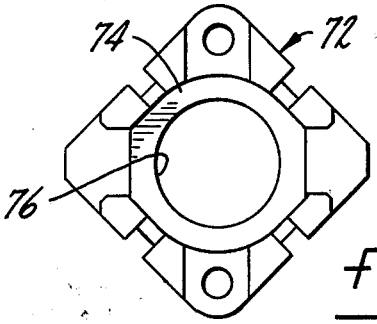
fig.8.

ILLUMINATED PUSHBUTTON SWITCH

SUMMARY OF THE INVENTION

The present invention relates to pushbutton switches of the type generally shown in my prior U.S. Pat. No. 3,826,884 and is specifically directed to illuminating means in a switch of that type.

A primary purpose of the invention is a pushbutton switch having illuminating means in which the light therefrom is directed through an opening in the switch contact to a light transmissive portion of the switch button.

Another purpose is a switch construction of the type described in which the switch contact includes a plurality of outwardly-extending arms, some of which are arranged for contact with terminals within the base, and others being disposed to receive the actuating force of the button.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of a switch of the type described,

FIG. 2 is a side view of the switch of FIG. 1,

FIG. 3 is an enlarged section along plane 3—3 of FIG. 1,

FIG. 4 is a view of the bottom of the switch button,

FIG. 5 is a top view of the switch base,

FIG. 6 is a top plan view of the switch contact,

FIG. 7 is a section, similar to FIG. 3, showing a modified form of switch, and

FIG. 8 is a top view of the switch base of FIG. 7.

DESCRIPTION OF THE PREFERRED EMBODIMENT

The present invention relates to a pushbutton switch of the type commonly used in keyboards and has particular relation to such a switch which may be mounted directly on a printed circuit board and includes illuminating means. The illuminating means may take many forms. It may be a small incandescent lamp, a light emitting diode, or any one of a number of lighting devices which have a long life, are small in size and reliably operable. Preferably, the illuminating means is positioned directly in view of a light transmissive portion of the switch button. Also, it is preferred that the illuminating means shine through a portion of the switch contact. This has the advantage of both decreasing the overall size of the switch and of using the opening in the contact to channel the light toward the light transmissive portion of the button.

The switch button is indicated generally at 10 and may be telescopically mounted upon a switch base 12. A pair of switch terminals 14 and 16 extend outwardly from the base 12 and are positioned in bores formed within the base. Many of the details of the switch construction are not shown and described herein, but may be found in my prior U.S. Pat. No. 3,826,884. Looking particularly at the structure in FIGS. 3, 4 and 5, the switch base 12 has a central opening or well 18 which accomodates a light emitting diode 20 having terminals 22 and 24 which extend downwardly through the base and into openings 26 and 28 in a printed circuit board 30. As is shown in FIG. 3, the base 12 may be mounted upon the upper surface of the P.C. board.

Positioned directly above and at least partially encircling the LED 20 is a coil spring 32, the lower coil of which is seated upon an annular support 34 around well 18 and which may be integral with the plastic base 12. The coil spring is positioned beneath a cross-shaped contact 38, which in fact rests upon the top coil of the spring.

The contact 38 may have four arms divided into two pairs, one pair being made up of arms 40 and 42, and the other pair being made up of arms 44 and 46. As is described in my prior patent, arms 44 and 46 may be disposed for contact with the switch terminals positioned within the base, whereas, arms 40 and 42 are positioned for contact by portions of the button. Looking particularly at FIG. 4, the button 10 has portions 48 which extend diagonally across opposed corners and which are positioned to contact arms 40 and 42 when the button is moved toward the base to thus cause the contact 38 to move downwardly to close the electrical connection between the terminal portions within the base.

The button may have a plurality, in this case four, rails 50 which extend from each side toward the center. There are mating grooves 52 in each side of the base with the rails 50 moving within the grooves 52 to maintain alignment of the button on the base. The base 12 may have a pair of oppositely-positioned grooves 54 which will receive the portions of the terminals electrically connected by the contact 38 when the button is closed upon the base. The button may have a generally central recess 51 to accomodate LED 20.

Contact 38 may have a central opening 56 which is directly in alignment with the LED 20. Both the opening 56 and the LED 20 are in turn aligned with a light transmissive or transparent portion 58 of the button 10. Preferably, generally the entire upper surface of the button 10 will be transparent, translucent or in some way at least partially light transmissive. There may also be indicia embedded within or carried by the light transmissive portion 58. Illumination from LED 20 will pass through the opening 56 in the contact 38 to illuminate the portion 58 of the button.

The switch may be arranged so that the LED or illuminating means 20 is always operating, or it may be operated only upon actuation of the switch.

The modification of FIGS. 7 and 8 places an LED 60 directly upon P.C. board 62. Terminals 64 and 66 of the LED 60 extend through openings 68 and 70 in the P.C. board. The support for the coil spring will be a circumferentially extending wall 74 which adjoins the opening 76 in the base which accommodates the LED 60. In other respects the button, contact and coil spring of the switch structure in FIGS. 7 and 8 will be the same as or similar to that in FIGS. 1–6.

Of importance in the invention is the fact that the switch is compact, easily manufactured and easily assembled. The illuminating means or light source is positioned within the base and preferably beneath the contact and in a manner to direct light through an opening in the contact. This provides substantial space saving advantages as well as providing a means for directing the light toward the light transmissive portion of the button.

Whereas the preferred form of the invention has been shown and described herein, it should be realized that there may be many modifications, substitutions and alterations thereto.

The embodiments of the invention in which an exclusive property or privilege is claimed are defined as follows:

1. A pushbutton switch including a base and a button telescopically mounted on the base, at least a portion of said button being light transmissive, spaced terminals extending outwardly from the base and having portions positioned within the base, spring means normally biasing the button away from the base, a contact having a plurality of outwardly extending substantially co-planar arms positioned between the base and button, certain of said arms being disposed for contact with said terminal portions, the remaining arms being disposed for contact by said button, means on the button for contacting said remaining arms to move said certain arms into contact with said terminal portions, said substantially co-planar arms being joined together in a central area, an opening generally in the center of said central area, a light emitting diode positioned within said base and on the side of said contact away from said button, said light emitting diode being positioned in direct alignment with said contact opening and said light transmissive button portion.

* * * * *